US010020129B2

(12) United States Patent
Kroeker et al.

(10) Patent No.: US 10,020,129 B2
(45) Date of Patent: Jul. 10, 2018

(54) CONTACT BRIDGE ARRANGEMENT FOR AN ELECTRICAL SWITCHING ELEMENT

(71) Applicant: TE Connectivity Germany GmbH, Bensheim (DE)

(72) Inventors: Matthias Kroeker, Mittenwalde-Ragow (DE); Peter Sandeck, Berlin (DE); Udo Gabel, Berlin (DE); Thomas Haehnel, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 35 days.

(21) Appl. No.: 15/200,095

(22) Filed: Jul. 1, 2016

(65) Prior Publication Data

US 2017/0011863 A1 Jan. 12, 2017

(30) Foreign Application Priority Data

Jul. 8, 2015 (DE) ..... 10 2015 212 817

(51) Int. Cl.
*H01H 1/20* (2006.01)
*H01H 50/54* (2006.01)
*H01H 1/26* (2006.01)

(52) U.S. Cl.
CPC ..... *H01H 1/20* (2013.01); *H01H 1/2008* (2013.01); *H01H 1/26* (2013.01); *H01H 50/546* (2013.01)

(58) Field of Classification Search
CPC ..... H01H 1/20; H01H 1/26; H01H 50/546; H01H 1/2008
USPC ..... 200/340, 520, 243, 283, 16 A
See application file for complete search history.

(56) References Cited

U.S. PATENT DOCUMENTS 4,594,484 A 6/1986 Lemmer
5,528,006 A * 6/1996 Gonin ..... H01H 13/06 200/16 A
6,924,449 B2 * 8/2005 Duchemin ..... H01H 1/2008 200/16 A
2015/0206684 A1 7/2015 Naka et al.

FOREIGN PATENT DOCUMENTS

EP 0162952 A1 4/1985
GB 2018030 A 10/1979
WO 2013117467 A1 8/2013

OTHER PUBLICATIONS

European Search Report, dated Oct. 31, 2016, 7 pages.
German Office Action, dated Apr. 20, 2016, 7 pages.

* cited by examiner

*Primary Examiner* — Edwin A. Leon
*Assistant Examiner* — Lheiren Mae A Caroc
(74) *Attorney, Agent, or Firm* — Barley Snyder

(57) ABSTRACT

A contact bridge arrangement for an electrical switch, such as a contactor or a relay, is disclosed. The contact bridge arrangement comprises a contact bridge having a contact bridge body, an actuating member on which the contact bridge is held that is movable with respect to the contact bridge along an actuating direction, the actuating member having a stop and a spring base, and a spring disposed between the spring base and the contact bridge body pressing the stop against the contact bridge.

22 Claims, 3 Drawing Sheets

CONTACT BRIDGE ARRANGEMENT FOR AN ELECTRICAL SWITCHING ELEMENT

CROSS-REFERENCE TO RELATED APPLICATION

This application claims the benefit of the filing date under 35 U.S.C. § 119(a)-(d) of German Patent Application No. 102015212817.2, filed Jul. 8, 2015.

FIELD OF THE INVENTION

The invention relates to an electrical switch, and more particularly, to a contact bridge arrangement for an electrical switch.

BACKGROUND

Contact bridge arrangements in an electrical switch, such as a relay, are known in the art. For example, DE 102012201967A1 describes a contact bridge arrangement in which a contact bridge is movable between a first stop and a second stop of an actuating member. The contact bridge is pressed against the second stop by a spring, which is supported on the first stop. The stops are generally designed as flanges on the actuating member, while the spring is a spiral pressure spring.

Assembly of such a known contact bridge arrangement can be unnecessarily complicated. Furthermore, the contact bridge lacks a guide, and consequently can tilt or twist while moving between the stops. Other known solutions attempt to remedy these problems by providing, for example, a contact bridge cage or a contact bridge fitting in which the contact bridge is guided while moving. Such solutions, however, require an unnecessarily complicated design, high manufacturing costs, and are impractically large.

SUMMARY

An object of the invention, among others, is to provide a contact bridge arrangement with a simplified design that takes up a small amount of space. The disclosed contact bridge arrangement includes a contact bridge having a contact bridge body, an actuating member on which the contact bridge is held that is movable with respect to the contact bridge along an actuating direction, the actuating member having a stop and a spring base, and a spring disposed between the spring base and the contact bridge body pressing the stop against the contact bridge.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a contact bridge arrangement.

This invention may, however, be embodied in many different forms, and should not be construed as limited to the embodiments set forth herein; rather, these embodiments are provided so that this disclosure will be thorough and complete and still fully convey the scope of the invention to those skilled in the art.

Figure 1:
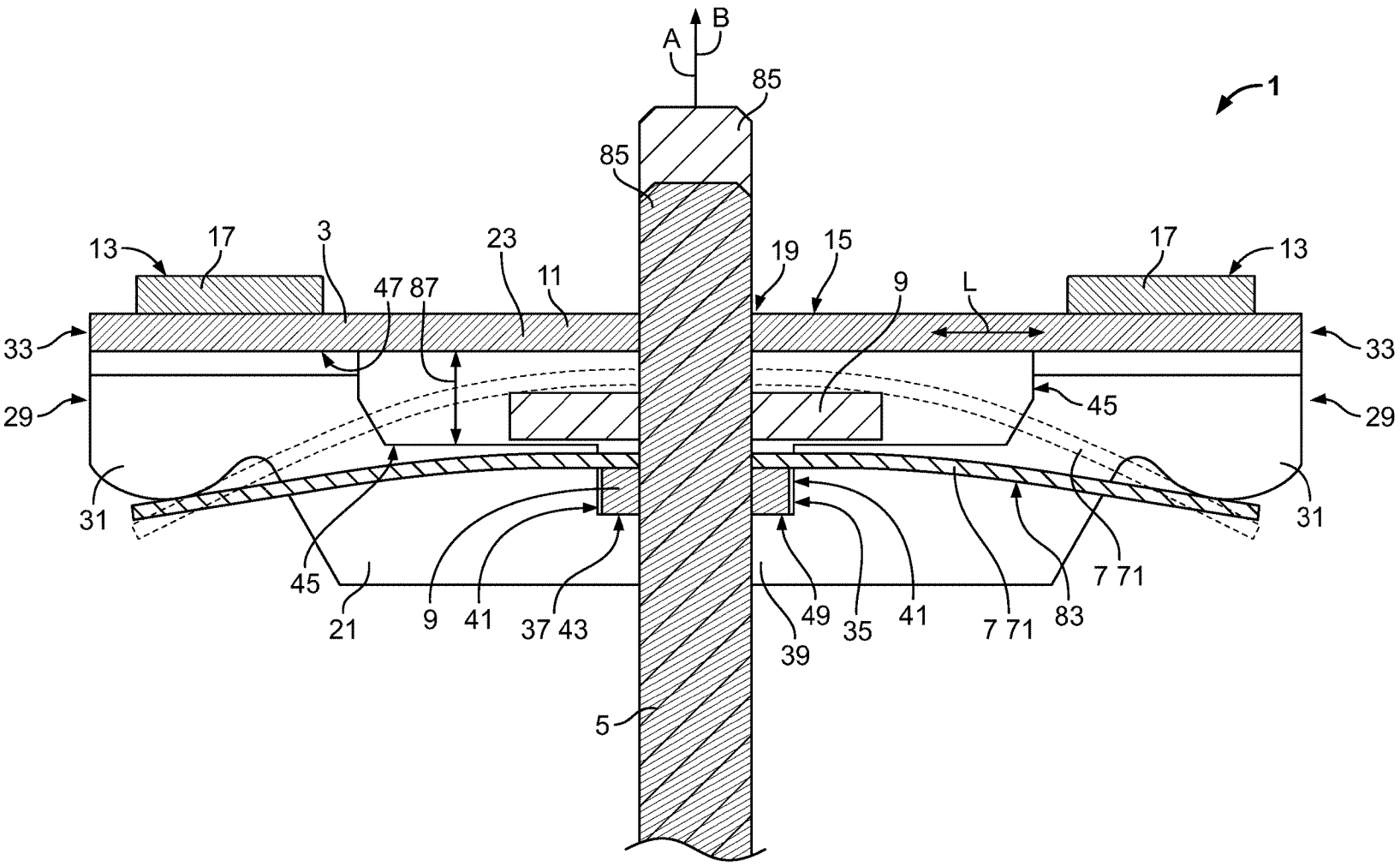
FIG. 1 is a sectional view of a contact bridge arrangement according to the invention parallel to a longitudinal direction of a contact bridge.

A contact bridge arrangement 1 according to the invention is shown generally in FIG. 1. The contact bridge arrangement 1 has a contact bridge 3, an actuating member 5, at least one spring element 7, and at least one stop 9. The major components of the invention will now be described in greater detail.

The contact bridge 3, as shown in FIG. 1, has a contact bridge body 11 which extends substantially along a longitudinal direction L. At least two contact surfaces 13, which are free in actuating direction B, are arranged on an upper side 15 of the contact bridge body 11. The contact surfaces 13 extend parallel to longitudinal direction L and perpendicular to actuating direction B. The contact surfaces 13 can be formed as regions of the contact bridge 3, or as separate contact elements 17 connected to the contact bridge 3. The contact surfaces 13, viewed in longitudinal direction L, are disposed near opposite ends of the contact bridge 3.

The contact bridge 3 also has a guiding aperture 19. The guiding aperture 19, as shown in FIG. 1, is arranged centrally in the contact bridge 3, in a middle of both the longitudinal direction L and a width direction Q shown in FIG. 3.

Figure 2:
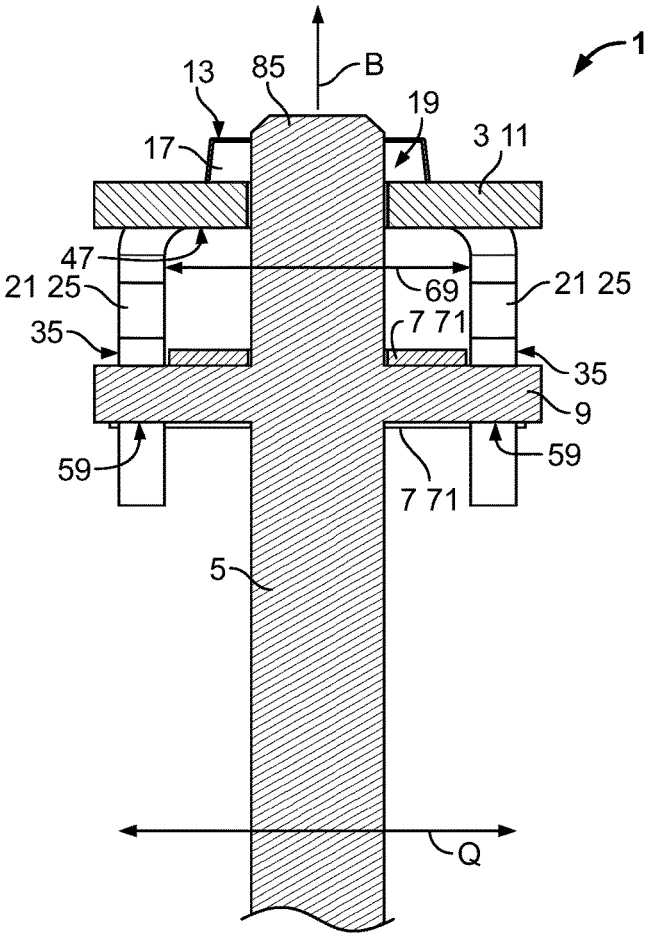
FIG. 2 is a sectional view of the contact bridge arrangement of FIG. 1 perpendicular to the longitudinal direction of the contact bridge.

The contact bridge 3 also has two legs 21, shown in FIGS. 1 and 2, which extend from the contact bridge body 11 counter to actuating direction B, and do not protrude over the upper side 15. The two legs 21 are opposite one another in the width direction Q. The legs 21 may be monolithically formed with the contact bridge 3; for example, they can be formed by reshaping contact bridge material 23 counter to actuating direction B. The legs 21 form lateral surfaces 25 of the contact bridge 3 which extend, at least in sections, parallel to longitudinal direction L and parallel to actuating direction B. The legs 21 may extend over the entire length 27 of the contact bridge 3 in the longitudinal direction L between leg ends 29. The legs 21 may extend in longitudinal direction L to such an extent that, viewed in longitudinal direction L, they are at the same height as the contact surfaces 13, at least in sections.

In the region of bridge ends 33 of the contact bridge 3 which are situated opposite one another in longitudinal direction L, the contact bridge 3 has spacers 31 which extend away from the contact bridge body 11 counter to actuating direction B. The spacers 31 may be formed monolithically with the legs 21, coincident with or forming the ends 29 of the legs 21 in longitudinal direction L. In the shown embodiment, the contact bridge 3 has spacers 31 at both ends 29 of both legs 21, such that four spacers 31 in total are provided.

Each of the legs 21 also has an aperture 35, shown in FIGS. 1 and 2, extending in a width direction Q through the leg 21. The aperture 35 may be arranged, viewed in longitudinal direction L, in the middle of the leg 21. The aperture 35 can extend parallel to the actuating direction B through the leg 21 up to a central wall section 37. The central wall section 37 can be part of a web 39 of leg 21, which limits the aperture 35 counter to actuating direction B. The web 39 runs substantially parallel to longitudinal direction L, as shown in FIG. 1. From the central wall section 37, the aperture 35 can extend in actuating direction B flanked by two lateral wall sections 41 which, viewed in longitudinal direction L, are situated opposite one another. The central wall section 37, in conjunction with the lateral wall sections 41, forms a seat 43.

Each of the legs 21 also has two mounting slots 45. The mounting slots 45 extend away from the seat 43 in opposite directions in longitudinal direction L. The mounting slots 45 may extend in actuating direction B up to an underside 47 of the contact bridge body 11. The mounting slots 45 may run parallel to longitudinal direction L, or may alternatively run obliquely toward the seat 43. The mounting slots 45, together with the aperture 35, form a common recess 49 in each leg 21. The common recess 49 may have a T-shape, as shown in FIG. 1, the vertical leg of the T running parallel to actuating direction B and being formed by the aperture 35, and the two horizontal legs of the T being formed by the mounting slots 45. Each leg 21 may alternatively have only one mounting slot 45, which extends away from the aperture 35 toward a leg end 29. In this case, the two legs 21 can be formed such that the two mounting slots 45 respectively run in opposite directions in longitudinal direction L.

Viewed in longitudinal direction L, the contact bridge 3 has a substantially U-shaped cross-section, as shown in FIG. 2, formed by the contact bridge body 11 and the legs 21. Due to the U-shape, the contact bridge 3 can have a high degree of stability against bending in actuating direction B.

The contact bridge 3 as disclosed above is manufactured as a stamped bent part; contact bridge material 23, which can at first be flat, can be stamped, as a result of which the shape of the contact bridge 3 is formed with the legs 21, the recesses 49 and the guiding aperture 19. In order not to take away too much material of the contact bridge body 11 when producing, for example, the recess 49, an annular section 51 shown in FIG. 3 may be formed in the region around the guiding aperture 19 having sufficient contact bridge material 23 to guarantee the stability of the contact bridge 3.

Figure 3:
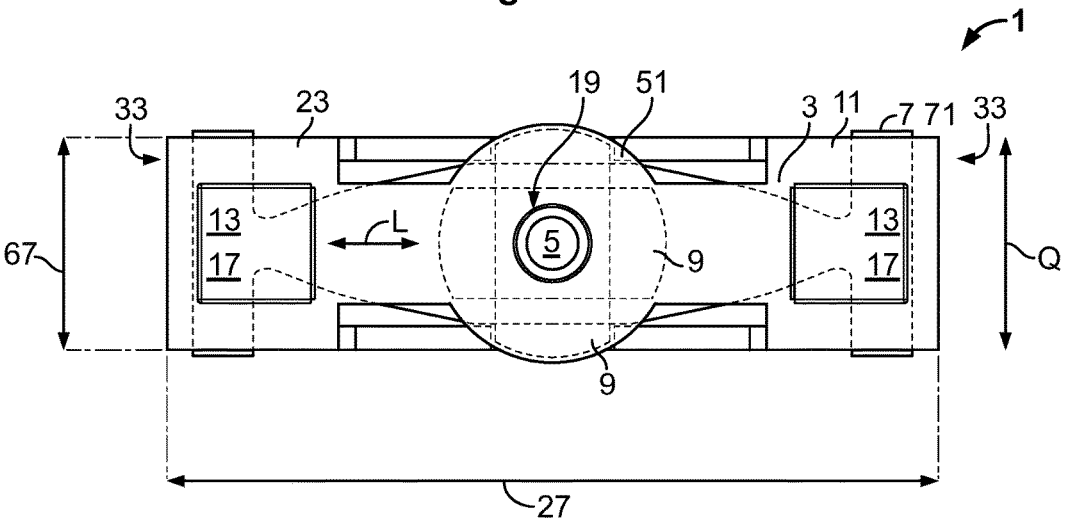
FIG. 3 is a plan view of the contact bridge arrangement of FIG. 1.
Figure 4:
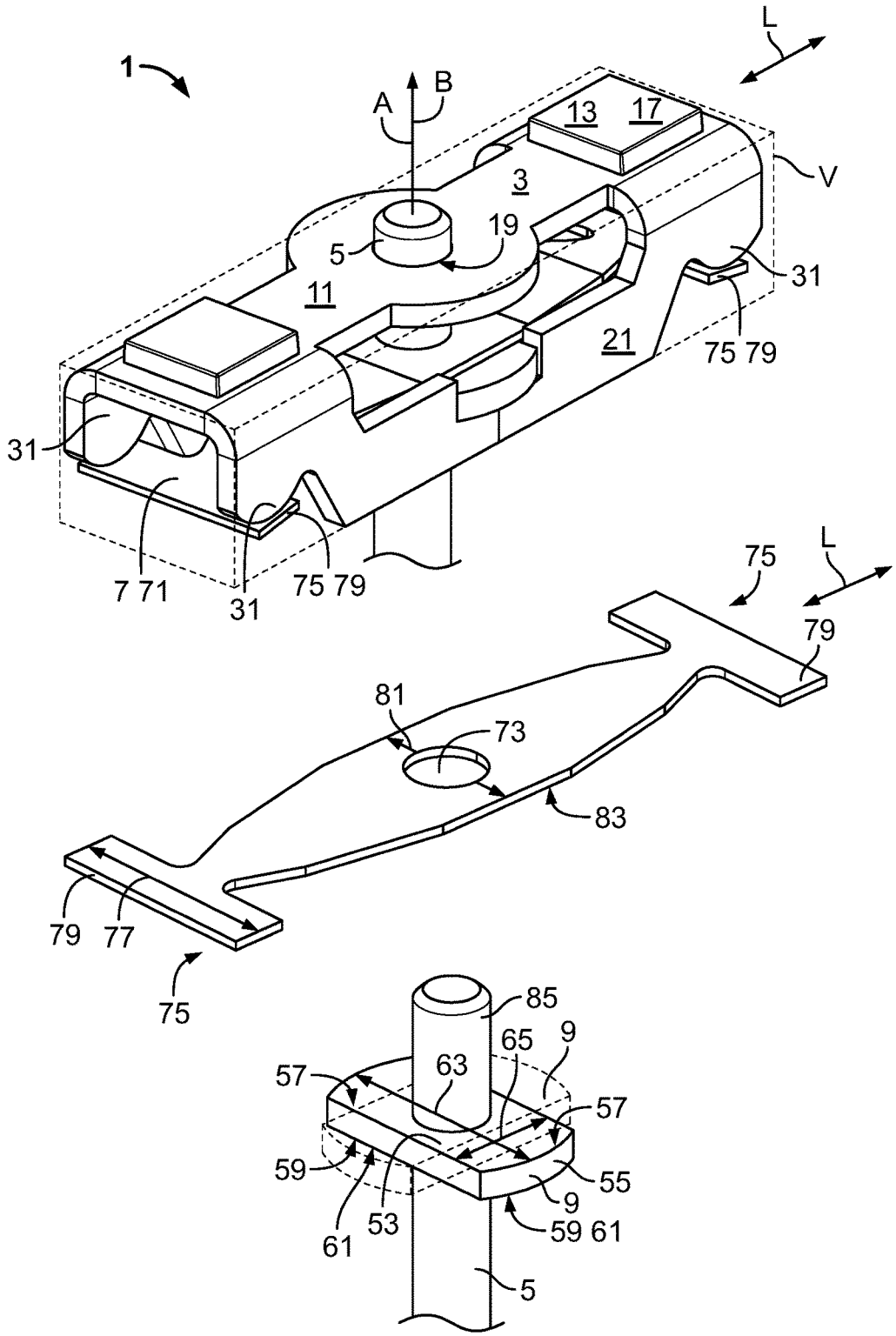
FIG. 4 is an exploded view of the contact bridge arrangement of FIG. 1.

The actuating member 5 is shown in FIGS. 1-4. The actuating member 5, as shown in FIG. 4, has a spring base 53 formed as an upper side 57 of a flange-shaped section 55. The flange-shaped section 55 has a length 63 and a width 65, and may be formed monolithically with the actuating member 5, or alternatively may be connected to it. The actuating member 5 may be rod-shaped or shaft-shaped.

The flange-shaped section 55 forms the stop 9. The stop 9 has the stop surfaces 59 which are formed by the underside 61 of the flange-shaped section 55. Upper side 57 and underside 61 relate to actuating direction B; the upper side 57 points in actuating direction B and the underside 61 points counter to this direction. The stop 9 has two stop surfaces 59 situated opposite one another transverse to actuating direction B. The stop 9 and the spring base 53 are configured monolithically with the flange-shaped section 55. FIGS. 3 and 4 show the stop 9 in a dashed line in two different positions.

The spring element 7 is shown in FIGS. 1 and 4. The spring element 7 may be a leaf spring 71, or alternatively may be a spiral spring or other suitable spring element known to those with ordinary skill in the art. Combined arrangements are also possible, in which there are several leaf springs 71 or combinations of at least one leaf spring 71 and at least one spiral spring. However, for the sake of simplicity, the use of an individual leaf spring 71 is described below.

The leaf spring 71 has an elongated, substantially planar shape with side 83 and, in a middle region, an insertion aperture 73. At its ends 75 situated opposite one another in longitudinal direction L, the leaf spring 71 has an end width 77. The end width 77 can be achieved by the leaf spring 71 having at its ends 75 cross-sectional widenings 79 wider than other portions of the leaf spring 71. Viewed in the longitudinal direction, the leaf spring 71 has, between the ends 75, a middle region width 81 which is smaller than the end width 77.

The assembly of the contact bridge arrangement 1 will now be described in greater detail.

The leaf spring 71 is seated, by its insertion aperture 73, onto the actuating member 5, until it bears against the spring base 53. Both the stop 9 and the spring base 53 are situated on the side 83 of the leaf spring 71 facing away from the contact bridge 3. Then, the actuating member 5, together with the leaf spring 71, is inserted in actuating direction B into the contact bridge 3.

The leaf spring 71 is positioned in a volume V defined by the contact bridge 3 and legs 21, as shown in FIG. 4. In this case, the flange-shaped section 55 or the stop 9 is oriented such that its longitudinal direction runs parallel to longitudinal direction L of the contact bridge 3. In this manner, the stop 9 fits between the two legs 21. Since the leaf spring 71 has at its ends 75 an end width 77 which is larger than the outer width 67 of the contact bridge 3, the ends 75 of the leaf spring 71 bear against the spacers 31. When inserted further, the leaf spring 71 can arch, with the region of the leaf spring 71 around the insertion aperture 73 being situated closer to the contact bridge body 11 than the ends 75, which are pushed away from a middle region of the leaf spring 71 by the spacers 31. Therefore, the spring tension of the leaf spring 71 has to be overcome during insertion.

During insertion, an upper end 85 of the actuating member 5 is inserted into the guiding aperture 19 of the contact bridge 3. As shown in FIG. 1, the actuating member 5 protrudes through the guiding aperture 19 and is movable with respect to the contact bridge 3 along actuating direction B. The guiding aperture 19 guides motion of the actuating member 5 with respect to the contact bridge 3.

In a state inserted into the contact bridge 3, as shown in FIGS. 1-3, the length 63 of the stop 9 is at least as large as an outer width 67 of the contact bridge 3, at least in the region of the legs 21. The outer width 67 is in this case measured parallel to the width direction Q. The width 65 of the stop is smaller than the inner spacing 69 of the legs 21. The inner spacing 69 of the legs 21 is measured parallel to the outer width 67 of the contact bridge 3. The middle region width 81 is smaller than the inner spacing 69 of the legs 21. As a result, the leaf spring 71 can be guided in a movable manner between the legs 21 in actuating direction B, at least by the region which does not exceed the middle region width 81.

The actuating member 5 is moved in actuating direction B until the stop 9 is arranged at the same height as the mounting slots 45. This is shown in FIG. 1 by the actuating member 5 and the stop 9 with the rough hatching, and the leaf spring 71 with dashed lines. In this case, the leaf spring 71 can arch until it bears against the underside 47 of the contact bridge body 11. Since the great arching causes the leaf spring 71 to lift off from the stop 9 in actuating direction B, the stop 9 is spaced apart from the underside 47 of the contact bridge body 11 by the arching of the leaf spring 71. This can be taken into account when specifying the dimensions of the mounting slots 45; the mounting slots 45 can have a mounting slot height 87 which makes it possible to bring the stop 9 to a height of the mounting slots 45, even if the stop 9 is spaced apart from the underside 47 of the contact bridge body 11 by the arching of the leaf spring 71.

If the stop 9 is at the same height as the mounting slots 45, then the actuating member 5 can be rotated about the axis A, which runs parallel to actuating direction B and in the middle through a longitudinal axis of the actuating member 5 and through the guiding aperture 19. In this case, the stop 9 can move through the mounting slots 45 of both legs 21 and be guided to the apertures 35. As soon as the stop 9 is oriented transverse to longitudinal direction L of the contact bridge 3, it is arranged over the seats 43. Then the stop 9 can be pressed into the two seats 43 by the spring force of the leaf spring 71 acting counter to the actuating direction B. If the stop 9 is arranged in both seats 43, it bears against both wall sections 37 by both of its stop surfaces 59.

A bayonet connection between the actuating member 5 and the contact bridge 3 is thus formed by the mounting slots 45, the seats 43 and the stop 9. The stop 9 is held in a form-fitting manner in the seats 43 both counter to the actuating direction B and in longitudinal direction L. The stop 9 can be moved out of each seat 43 only in the actuating direction B, with the spring force of the leaf spring 71 having to be overcome. The stop 9 is guided by the lateral wall sections 41 in actuating direction B, but does not move beyond the lateral wall sections 41 in actuating direction B such that the stop remains within the apertures 35.

In an alternative embodiment not shown, the contact bridge 3 may be formed without mounting slots 45. Instead, each leg 21 has only one aperture 35 with one seat 43 for the stop 9. Before mounting, the contact bridge 3 does not have a U-shaped cross-section, but rather, the two legs 21 are spaced even further apart from one another than would be the case with a U-shaped cross-section. The actuating member 5 and the spring element 7 are brought into the desired position, then, the legs 21 of the contact bridge 3 are arched until the final shape of the contact bridge 3 is produced. When reshaping the contact bridge 3 or bending the legs 21 counter to actuating direction B, the stop 9 can penetrate into the apertures 35 on both sides of the contact bridge 3, so that it is arranged in its seat 43 at each leg 21. In this embodiment, viewed in the actuating direction B, the stop 9 or flange-shaped section 55 may be formed to be circular, or alternatively could have a square shape, or any other suitable shape known to those with ordinary skill in the art.

Advantageously, in the contact bridge arrangement 1 of the present invention, since the legs 21 extend over the entire length 27 of the contact bridge 3, the legs 21 can be produced quickly by reshaping; it is thus not necessary to remove material at the ends 29 which are opposite one another in longitudinal direction L. Moreover, this design can ensure that the contact bridge 3 has an increased stability compared to bending in the actuating direction B. Due to the planar shape, the leaf spring 71 can also be particularly easily cut out or stamped out of spring steel. Furthermore, since the leaf spring 71 is positioned within the contact bridge 3, it is possible to limit the size of the contact bridge arrangement 1. The design of the contact bridge arrangement 1 also makes it possible to dispense with having to seat a second stop or flange on the actuating member 5 after the contact bridge 3 has been seated on the actuating member 5, as in the known prior art. More space thus can be available, for example, for contact surfaces 13 on the upper side of the contact bridge.

What is claimed is:

1. A contact bridge arrangement for an electrical switch, comprising:

a contact bridge having a contact bridge body;

an actuating member on which the contact bridge is held that is movable with respect to the contact bridge along an actuating direction, the actuating member having a stop and a spring base, the stop extending through an aperture of the contact bridge; and a spring disposed between the spring base and the contact bridge body pressing the stop against the contact bridge.

2. The contact bridge arrangement of claim 1, wherein the stop and the spring base are disposed on a side of the spring opposite the contact bridge body.

3. The contact bridge arrangement of claim 2, wherein the stop is formed monolithically with the spring base.

4. The contact bridge arrangement of claim 3, wherein the spring base and the stop are part of a flange-shaped section of the actuating member.

5. The contact bridge arrangement of claim 1, wherein the spring is received within a volume defined by the contact bridge.

6. The contact bridge arrangement of claim 1, wherein the aperture guides motion of the stop in the actuating direction.

7. The contact bridge arrangement of claim 6, wherein the stop is pressed against a central wall section of the aperture extending transverse to the actuating direction.

8. The contact bridge arrangement of claim 7, wherein the central wall section and two lateral wall sections of the aperture extending parallel to the actuating direction form a seat.

9. The contact bridge arrangement of claim 8, wherein the stop is disposed in the seat.

10. The contact bridge arrangement of claim 9, wherein the aperture has a mounting slot extending away from the seat substantially transverse to the actuating direction.

11. The contact bridge arrangement of claim 10, wherein the aperture and stop form a bayonet connection.

12. The contact bridge arrangement of claim 11, wherein the contact bridge has a leg extending counter to the actuating direction.

13. The contact bridge arrangement of claim 12, wherein the aperture is disposed in the leg.

14. The contact bridge arrangement of claim 13, wherein the leg is formed monolithically with the contact bridge body.

15. The contact bridge arrangement of claim 14, wherein the contact bridge has two legs positioned opposite one another and extending transverse to the actuating direction.

16. The contact bridge arrangement of claim 15, wherein the stop has a first dimension at least as long as an outer width of the legs.

17. The contact bridge arrangement of claim 16, wherein the stop has a second dimension smaller than an inner spacing of the legs.

18. The contact bridge arrangement of claim 1, wherein the spring is a leaf spring.

19. The contact bridge arrangement of claim 1, wherein the actuating member extends through the spring and the contact bridge body.

20. A contact bridge arrangement for an electrical switch, comprising:

a contact bridge having a contact bridge body;

an actuating member on which the contact bridge is held that is movable with respect to the contact bridge along an actuating direction, the actuating member having a stop and a spring base; and a spring disposed between the spring base and the contact bridge body pressing the stop against the contact bridge, the stop and the spring base disposed on a side of the spring opposite the contact bridge body.

21. The contact bridge arrangement of claim 20, wherein the stop is formed monolithically with the spring base.

22. The contact bridge arrangement of claim 21, wherein the spring base and the stop are part of a flange-shaped section of the actuating member.

* * * * *